US006454627B1

(12) United States Patent
Mak

(10) Patent No.: US 6,454,627 B1
(45) Date of Patent: Sep. 24, 2002

(54) MUSICAL ENTERTAINMENT DOLL

(75) Inventor: Danny Wai Keung Mak, Kowloon (HK)

(73) Assignee: Well Creation Limited, Kowloon (HK)

( * ) Notice: Subject to any disclaimer, the term of this patent is extended or adjusted under 35 U.S.C. 154(b) by 0 days.

(21) Appl. No.: 09/845,607

(22) Filed: Apr. 30, 2001

(51) Int. Cl.[7] ..... A63H 3/02; A63H 3/28

(52) U.S. Cl. ..... 446/369; 446/297; 446/408; 446/390; 84/470 R

(58) Field of Search ..... 446/175, 369, 446/297, 143, 408, 485, 484, 303, 302, 301, 300, 299, 298, 390; 434/228, 230, 231, 232; 84/470 R, 471 R, 478, 477 R, 479 A

(56) References Cited

U.S. PATENT DOCUMENTS 2,178,903 A * 11/1939 Cole ..... 446/408
3,570,360 A * 3/1971 Siegel ..... 84/477 R
3,593,433 A * 7/1971 Dillon et al. ..... 446/302
3,595,121 A * 7/1971 Magers ..... 446/302
3,977,292 A * 8/1976 Favilli et al. ..... 446/297
4,350,070 A * 9/1982 Bahu ..... 84/477 R
4,516,950 A * 5/1985 Berman et al. ..... 446/297
4,706,536 A * 11/1987 Sanders ..... 84/471 R
5,478,240 A * 12/1995 Cogliano ..... 446/143
5,795,213 A * 8/1998 Goodwin ..... 446/297
5,944,533 A * 8/1999 Wood ..... 434/167
6,057,501 A * 5/2000 Hale ..... 84/470 R
6,132,281 A * 10/2000 Klitsner et al. ..... 446/397
6,193,579 B1 * 2/2001 Mak ..... 446/369
6,224,455 B1 * 5/2001 Laurienzo ..... 446/297
6,264,523 B1 * 7/2001 Simmons ..... 446/143

* cited by examiner

*Primary Examiner*—Derris H. Banks
*Assistant Examiner*—Urszula M Cegielnik
(74) *Attorney, Agent, or Firm*—G. Brian Pingel; Camille L. Urban

(57) ABSTRACT

A child's portable toy having an audio signal producer is provided with a plurality of pressure switches designating different tones of a fixed interval scale. When one of the pressure switches is depressed, the sound of a corresponding tone is produced through a speaker provided in the toy so that a child may play a melody thereon.

11 Claims, 4 Drawing Sheets

MUSICAL ENTERTAINMENT DOLL

BACKGROUND OF THE INVENTION

1. Field of the Invention

The present invention relates in general to a child's toy provided with electronically actuated tones, and more particularly, to a child's toy which provides an audio tone upon actuation of a portion of the toy identifying the desired tone.

2. Description of the Prior Art

It is known in the art to provide portable toys with a tape or similar medium to play pre-recorded songs. In such toys, a tape is placed within a plush animal and played for the child's enjoyment. Other toys in the art include those with surfaces which require a striking mallet to create percussed sound or mechanisms for creating certain sounds when actuated. Still other toys produce sound when actuated by blowing into a mouthpiece or programming through a MIDI-like application using a computer.

A major drawback associated with the pre-recorded playback devices is the lack of creativity employed by and interactivity required from the child operating the device.

A disadvantage of other toys on the market is their lack of versatility in that they are hard surfaced instrument/toys that are not cuddly and soft or they require a component outside the toy itself in order to program or dictate the sound to be played increasing both cost and incompatability with children's play patterns.

SUMMARY

The present invention provides a musical device for audibly producing tones from within a fixed interval scale to the listener on his command. The device includes a portable toy having an electrical power source and eight actuators. Signal producing means are also provided and coupled to each of the actuators. The signal producing means is for production of an audio signal upon actuation of each actuator, such audio signal being one of eight tones at fixed pitch intervals depending upon which actuator is actuated.

In the preferred embodiment, the tones produced are those found in a major melodic scale which are numbered in increasing pitch. Preferably, the toy is constructed of soft material and is provided with a head, body, legs, and a keyboard-like appendage, all of the same soft material. The actuators are provided on the keyboard-like appendage of the toy. In addition, a holder is mounted on the front of the toy upon which cards with melodies composed by numbers corresponding to the actuators are printed. The actuators are designated with numbers in sequence and corresponding to the numbered tones. When a child actuates a specifically numbered actuator, the toy produces the corresponding tone making it possible for a child to play melodies as he chooses or by reading the melodies printed by corresponding numbers.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(s)

Figure 1:
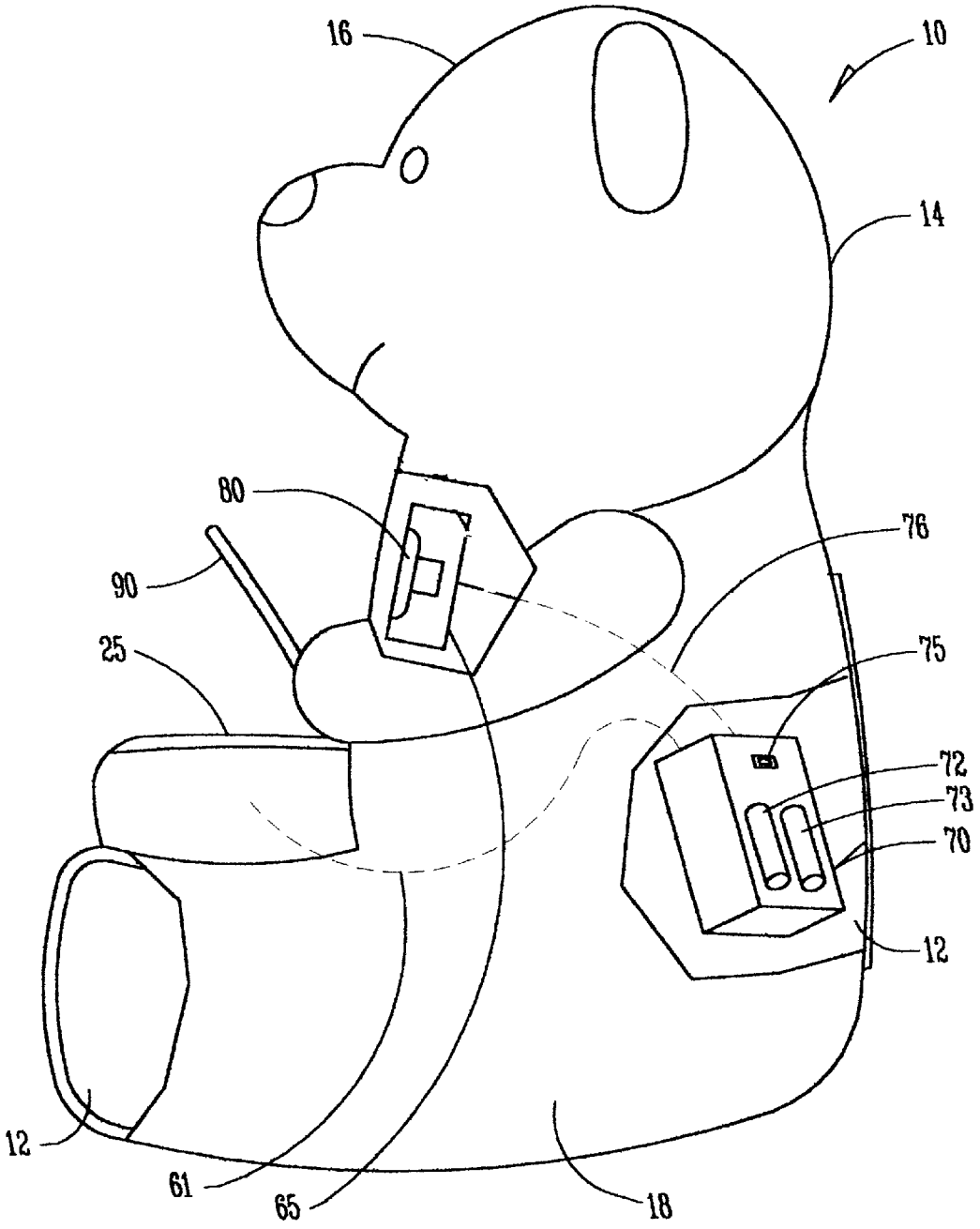
FIG. 1 is a side elevation in partial cut-away and partial phantom showing a preferred embodiment of the portable toy of the present invention.
Figure 2:
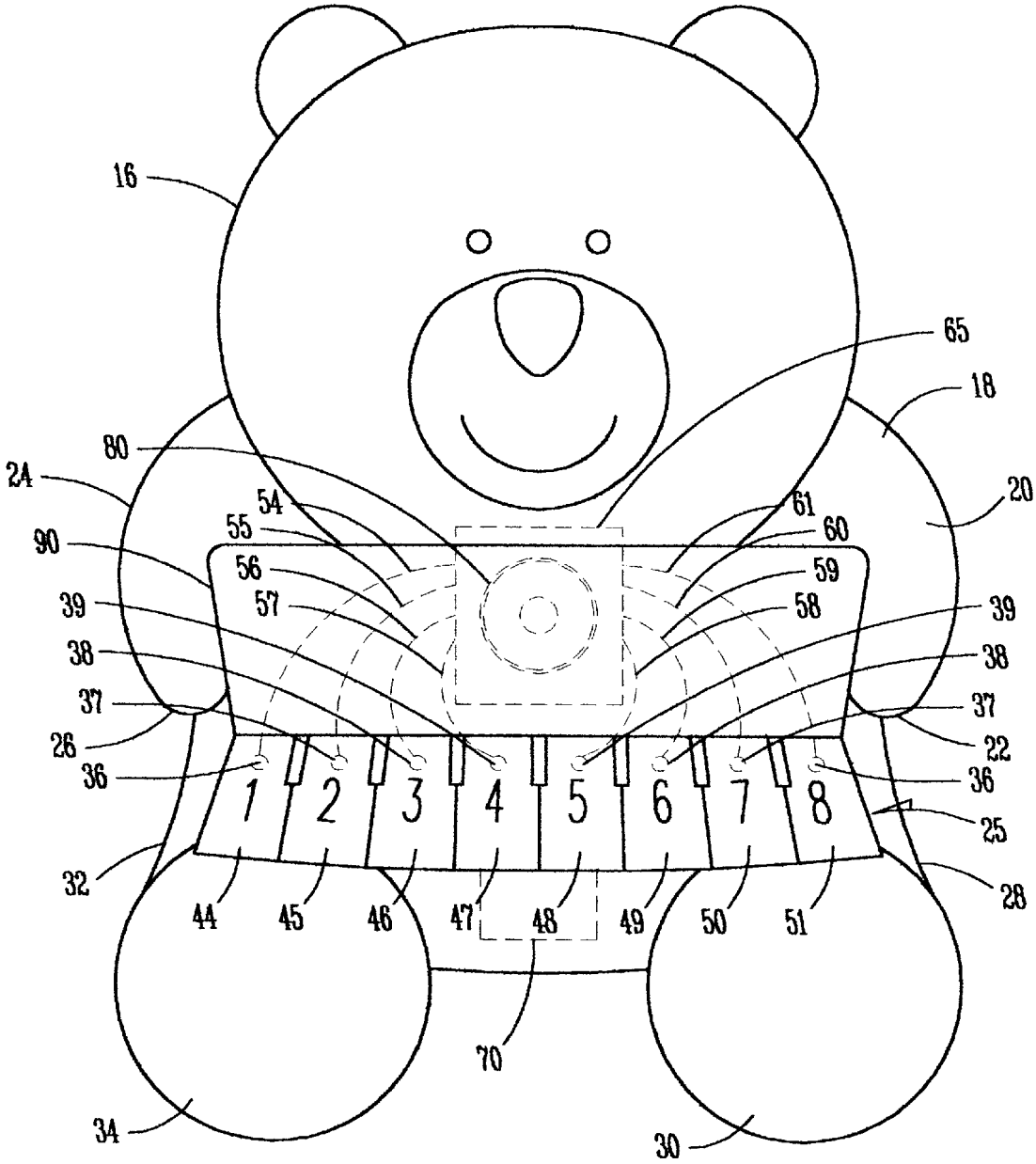
FIG. 2 is a front elevation in partial phantom showing the portable toy of FIG. 1.

With reference to the drawings, a child's toy, commonly referred to as a "teddy bear" is indicated generally at 10 in FIG. 1. The toy 10 is preferably provided with an interior 12 and an exterior shell 14. While the shell 14 may be of any suitable material, it is preferably constructed of cotton, polyester or some other plush material. As shown in FIG. 2, the toy 10 is preferably provided with a head 16, a body 18, a left arm 20, a left hand 22, a right arm 24, a right hand 26, a left leg 28, a left foot 30, a right leg 32 and a right foot 34 and a keyboard-like appendage 25.

As further shown in FIG. 2 the keyboard-like appendage 25 is generally rectangular in shape and also, preferably made of some soft plush construction. The keyboard-like appendage is positioned between the toy's hands 22 and 26 and above the toys' legs 28 and 32. The keyboard-like appendage 25 is provided with pressure switches 36–43, each designated with a number 44–51 which in this embodiment are "1", "2", "3", "4", "5", "6", "7", and "8" and resemble piano keys.

As shown in FIGS. 1 and 2, the pressure switches 36 through 43 are connected by wires 54 through 61 to a control unit 65. The control unit 65 is preferably an integrated circuit (IC) chip designed to function as described below.

As shown in FIG. 1, the control unit 65 is coupled to a battery pack power source 70. The battery pack 70 preferably holds two AA batteries 72, 73 but may, of course, hold any suitable power source. The toy 10 preferably is provided with a velcro closure or similar means to allow the battery pack 70 to be serviced and/or replaced. The battery pack 70 is actuated by a switch 75 on the battery pack 70 and is connected by a wire 76 to the control unit 65.

The control unit 65 is programmed, as is known in the art, to produce electrical signals in response to actuation of the pressure switches 36–43, which signals travel to a speaker 80 through a wire (not shown) to create sound. The speaker 80 is shown located near the front side of the interior 12 of the toy 10 to provide maximum audio sound to the child, however, the speaker 80 can be placed elsewhere in the toy 10 as desired.

Figure 3:
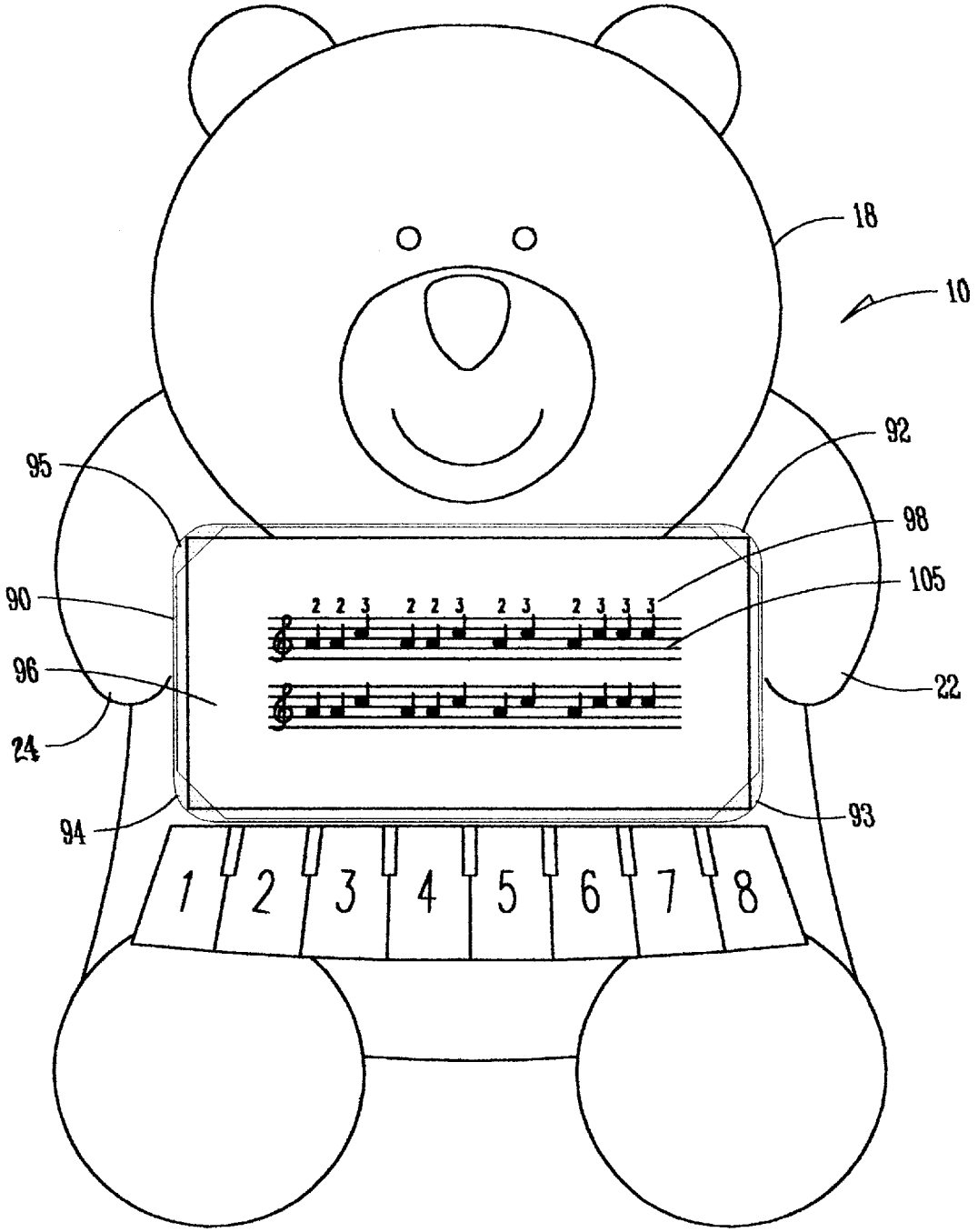
FIG. 3 is a front elevation showing the portable toy of FIG. 2 with a music card mounted on its front.
Figure 4:
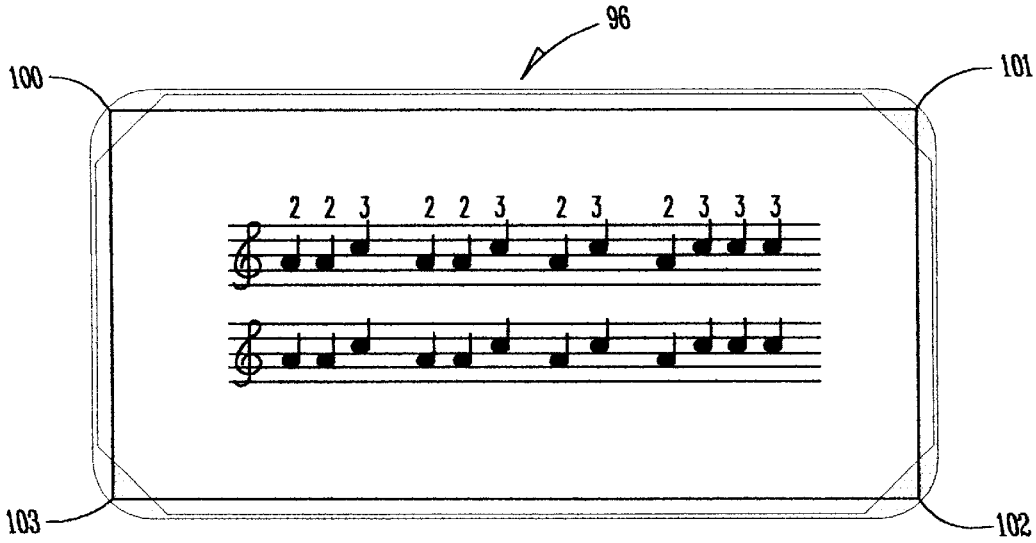
FIG. 4 is a front elevation of the music card.
Figure 4A:
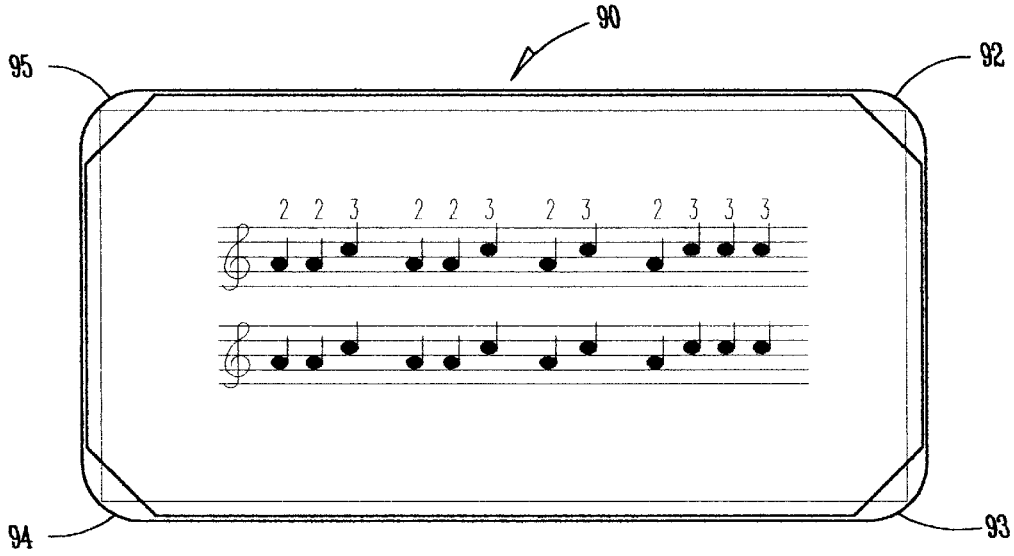
FIG. 4*a* is a front elevation an envelope into which the music card of FIG. 4 fits.

As shown in FIG. 3 the left hand 22 is attached to a music card holder 90 as is the right hand 26 of the toy 10. The music card holder 90 is provided with comer pockets 92 through 95 into which a generally two-dimensional music card 96 having corners 100 through 103 can be inserted as shown in FIGS. 4 and 4*a*. The music card 96 displays a written melody of notes 105 and also provides numbers 98 which correspond to the tones in the melody.

To operate the toy 10 of the present invention, the music card 96 may be mounted by inserting its comers 100 through 103 into the pockets 92 through 95. The toy 10 is then activated by the switch 75 located on the battery pack 70. Then, the child can either read the notes of the melody as indicated by numbers 98 on the music card 96 and pressing the correspondingly labeled pressure switches 36 through 43 on the toy's keyboard-like appendage 25. As he learns to associate the notes 105 on a musical staff with the location on the simulated keyboard 25, the child will acquire the basic skills to read and play music on a keyboard. Or, the child can simply play tones as he or she desires by pressing the pressure switches 36 through 43 in any order.

Thus, the present invention has been described in an illustrative manner. It is to be understood that the terminology that has been used is intended to be in the nature of words of description rather than of limitation.

Many modifications and variations of the present invention are possible in light of the above teachings. For example, the pressure switches could be located in other locations on the toy or the sound produced could mimic a particular musical instrument. Therefore, within the scope of the appended claims, the present invention may be practiced otherwise than as specifically described.

What I claim is:

1. A child's toy for audibly producing musical tones comprising a portable toy having an interior and comprising the following elements at least some of which are within said interior:

a) an electrical power source;

b) manually actuable means to initiate said power source;

c) a plurality of switch means that can be activated by a child;

d) a signal producing means coupled to said plurality of switch means for producing a different electrical signal depending upon which switch means is actuated by the child;

e) a sound producing means for receiving said electrical signals from said signal producing means and for producing a different musical note for each of said electrical signals received;

f) means to couple said signal producing means to said sound producing means and to said power source;

g) a body;

h) a head secured to said body;

i) two arms each with an associated hand secured to said body;

j) two legs each with a top surface;

k) an appendage resembling a piano keyboard and associated with said top surfaces of said legs;

l) an exterior substantially made of plush material ; and m) a music card comprising a generally rectangular page containing written material, said material being capable of audio musical interpretation.

2. A child's toy as claimed in claim 1 further comprising means by which to mount said music card on said toy wherein said means comprises two corner pockets mounted on each of said hands and corresponding to the shape of said page.

3. A child's toy as claimed in claim 1 wherein location of each of said switch means is identified by a symbol on said toy.

4. A child's toy as claimed in claim 2 further comprising:

a) a location of each of said switch means is identified by a symbol on said toy;

b) a plurality of symbols identifying said switch means are located on said appendage resembling a piano keyboard; and c) said written material contained by said music card comprises indicia corresponding with musical tones of a tune and said symbols located on said appendage resembling a piano keyboard.

5. A child's toy as claimed in claim 1 wherein said switch means are in the form of a plurality of pressure switches.

6. A child's toy as claimed in claim 5 wherein each of said plurality of pressure switches is located adjacent to one of each of a plurality of simulated keys on said appendage resembling a piano keyboard.

7. A child's toy for audibly producing musical tones comprising:

a) an interior comprising a sound assembly comprising an electrical power source, a plurality of switch means, a signal producing means coupled to said plurality of switch means for producing a different electrical signal depending upon which switch means is actuated, a sound producing means for receiving said electrical signals from said signal producing means and for producing a different musical note for each of said electrical signals received, and means to couple said signal producing means to said sound producing means and to said power source;

b) an exterior comprising a soft material covering, the shape of a teddy bear with a head, two arms, two hands, two legs, an appendage resembling a piano keyboard associated with said legs, at least one music card and a music card holder associated with said hands;

c) manually actuable means to initiate said power source accessible from said exterior;

d) said appendage resembling a piano keyboard further comprising a plush exterior decorated with a plurality of simulated keys and an interior which includes each of said plurality of switch means located interior and adjacent to each of said plurality of simulated keys; and e) said music card holder further comprising a generally rectangular shape with four corners and pockets at each of said corners for detachably securing said music card.

8. A child's toy for audibly producing musical tones comprising:

a) an exterior comprising:

1) a head;

2) two hands;

3) two legs each with a top surface;

4) an appendage resembling a piano keyboard attached to said top surface of each said leg and decorated with eight simulated piano keys; and 5) a covering made substantially of soft material;

b) an interior comprising;

1) an electrical power source including a manual means for initiating said power source;

2) a plurality of pressure switches located in said appendage resembling a piano keyboard;

3) a signal producing means coupled to said plurality of pressure switches for producing a different electrical signal depending upon which switch is actuated;

4) a sound producing means for receiving said electrical signals from said signal producing means and for producing a different musical note for each of said electrical signals received;

5) means to couple said signal producing means to said sound producing means and to said power source; and 6) soft material.; and c) a music card of generally rectangular shape.

9. A child's toy for audibly producing musical tones as claimed in claim 8 further comprising a music card holder attached to said hands.

10. A child's toy for audibly producing musical tones as claimed in claim 9 further comprising a plurality of written symbols on said card each said symbol corresponding to a musical tune.

11. A child's toy for audibly producing musical tones as claimed in claim 10 wherein each of said simulated keys further comprises a symbol which corresponds to said symbols on said music care and said music card holder further comprises two pockets near each hand into which said music card can be detachably secured.

* * * * *